US006829970B2

(12) United States Patent
Hong

(10) Patent No.: US 6,829,970 B2
(45) Date of Patent: Dec. 14, 2004

(54) TAPE GUIDE DEVICE FOR AUTOMATIC ROLL TAPE CUTTER

(76) Inventor: Myon Ki Hong, #602, Greenhillvillat Villa, 198-36, Mia 3-Dong, Gangbuk-Gu, Seoul (KR)

( * ) Notice: Subject to any disclaimer, the term of this patent is extended or adjusted under 35 U.S.C. 154(b) by 0 days.

(21) Appl. No.: 10/370,704

(22) Filed: Feb. 24, 2003

(65) Prior Publication Data

US 2004/0020341 A1 Feb. 5, 2004

(30) Foreign Application Priority Data

Aug. 2, 2002 (KR) ..... 20-2002-0023193

(51) Int. Cl.[7] ..... B26D 7/01

(52) U.S. Cl. ..... 83/436.3; 83/175; 83/649; 83/706; 101/288; 400/619

(58) Field of Search ..... 83/175, 436.3, 83/649, 706, 709, 436.1, 542, 409; 225/51, 106; 271/109; 226/17, 49, 89; 400/619, 621; 101/288; 399/385

(56) References Cited

U.S. PATENT DOCUMENTS 3,799,018 A * 3/1974 Mumford ..... 83/298
3,935,776 A * 2/1976 Dingus ..... 83/425.4
4,754,674 A * 7/1988 Perlman ..... 83/422
4,953,430 A * 9/1990 Hong ..... 83/155
5,265,859 A * 11/1993 Watson et al. ..... 271/109
5,415,611 A * 5/1995 Krayenhagen ..... 492/16
5,982,512 A * 11/1999 Kim ..... 358/498
6,105,899 A * 8/2000 Harris ..... 242/615.1
6,555,152 B1 * 4/2003 Roso ..... 426/516
6,616,136 B1 * 9/2003 Huang et al. ..... 271/10.13

* cited by examiner

*Primary Examiner*—Allan N. Shoap
*Assistant Examiner*—Phong Nguyen
(74) *Attorney, Agent, or Firm*—Birch, Stewart, Kolasch & Birch, LLP

(57) ABSTRACT

Disclosed is a tape guide device for an automatic roll tape cutter, the toll tape cutter including a tape feed-out unit housed in a case for feeding out a roll tape loaded in a tape loading portion thereof through a plurality of guide rollers from a supply roller thereof, and a tape cutting unit which is mounted in front of the case for cutting the tape fed out at a proper length, the tape guide device comprising: a body disposed between the tape loading portion and the supply roller of the tape feed-out unit and having both ends, one end of which is hingeably mounted to one side wall of the tape feed-out unit as to be elastically biased toward an opening direction, and the other free end of which has engaging protrusions formed thereon; a first guide roller installed at the rear end of the body and having engaging recesses formed on an outer circumference of both ends thereof; a pair of stoppers horizontally installed inside the body in such a manner as to be moved oppositely with respect to each other, each of the stoppers having, at one end, a fixing piece protruded outwardly from the body so as to be inserted into the engaging recess of the first guide roller and being elastically biased toward its engaging direction; a second guide roller installed at the front end of the body; and a locker mounted to the other side wall of the tape feed-out unit for restricting the engaging protrusions of the body so as to fix the body in a closed state, whereby during the feeding out of the roll tape from the rolls, the tape is fed out along a curved face while maintaining a proper tension, thereby preventing the tape fed out from being twisted or entangled.

3 Claims, 6 Drawing Sheets

TAPE GUIDE DEVICE FOR AUTOMATIC ROLL TAPE CUTTER

This nonprovisional application claims priority under 35 U.S.C. § 119(a) on Patent Application No. 2002-23193 filed in KOREA on Aug. 2, 2002, which is herein incorporated by reference.

BACKGROUND OF THE INVENTION

1. Field of the Invention

The present invention relates to an automatic roll tape cutter, more particularly, to a tape guide device for an automatic roll tape cutter, which prevents a wound tape from being entangled or twisted due to a tension by a plurality of guide rolls while the tape is fed out.

2. Description of the Related Art

In general, when goods are shipped out from manufacturing companies or goods are sold in such various stores as department stores or large discount stores, these various goods will be properly packed with a packing material like paper. Such a packing paper is mainly bonded by means of a band-type adhesive tape.

For the purpose of the more efficient and fast packing of goods, a so-called automatic roll tape cutter has been provided and widely used which has a large wound tape, i.e., roll tape contained therein, and, during packing, feeds out a required length of the wound adhesive tape and cuts the same automatically.

Such an automatic roll tape cutter, as shown in FIG. 1, generally comprises upper and lower cases 1 and 2, a tape feed-out unit 3 installed in the cases 2 and 3 for feeding out a tape by means of a plurality of rollers interlocked with a driver and a tape cutter 4 openably installed in front of the upper case 1 for cutting the fed-out tape.

The automatic roll tape cutter also comprises a tape mounting portion (not shown) into which a roll-type tape is inserted. However, for the automatic roll tape cutter problems exist in that the tape mounting portion and the roll tape are not identical to each other in size due to the inner diameters of the roll tape being designed differently as well as a plurality of guide rolls are properly arranged in such a manner as to suitably maintain a tension of the tape being.

First, when the wound roll tape is fed out, it is bent at a right angle due to the material of the tape and its adhesive. At this time, although a degree of bending can be varied with adhesive force of the tape, the bent portion of the tape during the feeding out of the tape is deformed and then entangled or twisted without being spread out straightly Second, while the tape is led out through a plurality of guide rollers, it frequently becomes jammed into between the rolls or is entangled in the rollers. If such leading-out operation is continued, a load occurring at each of the rollers prevents the rotation of the rollers. In this case, an operator suffers from an inconvenience of monitoring the tape being fed out and removing the tape jammed or entangled from the rollers, and the working is delayed accordingly.

Third, since the inner diameters of the tape is not constant with those of various tapes, the centers of the tape mounting portion and the tape are not identical to each other, thereby causing delay of the working and, in a worse case, the roll tap cannot be used.

SUMMARY OF THE INVENTION

Accordingly, an object of the present invention is to solve the problems of the conventional tape cutter by providing a tape guide device for automatic roll tape cutter, which during the feeding out of a roll tape, prevents the tape from being entangled or twisted due to deviation of the center of the tape and which, upon the generation of an erroneous operation during the feeding of the roll tape, regulates a guiding plate movably installed at both ends so as to simply correct the erroneous operation.

To accomplish the object of the present, according an aspect of the present invention, there is provided a tape guide device for an automatic roll tape cutter, the roll tape cutter including a tape feed-out unit housed in a case for feeding out a roll tape loaded in a tape loading portion thereof through a plurality of guide rollers from a supply roller thereof, and a tape cutting unit which is mounted in front of the case for cutting the tape fed out at a proper length, the tape guide device comprising: a body disposed between the tape loading portion and the supply roller of the tape feed-out unit and having both ends, one end of which is hingeably mounted to one side wall of the tape feed-out unit as to be elastically biased toward an opening direction, and the other free end of which has engaging protrusions formed thereon; a first guide roller installed at the rear end of the body and having engaging recesses formed on an outer circumference of both ends thereof; a pair of stoppers horizontally installed inside the body in such a manner as to be moved oppositely with respect to each other, each of the stoppers having, at one end, a fixing piece protruded outwardly from the body so as to be inserted into the engaging recess of the first guide roller and being elastically biased toward its engaging direction; a second guide roller installed at the front end of the body; and locking means mounted to the other side wall of the tape feed-out unit for restricting the engaging protrusions of the body so as to fix the body in a closed state.

In the tape guide device of the present invention, the locking means is hinged to the side wall of the tape feed-out unit so as to be elastically biased toward its locking direction, and has a hook for elastically engaging and restricting the engaging protrusion of the body.

According to the present invention, when the tape is feed fed out from a supply roll while being properly tensioned from a point of time of the feeding-out along a curved face by the guide roller, it could be prevented from being entangled or twisted, and even in the case where an error operation occurs due to the tape being jammed into the guide roller during the feeding of the tape, the tape could be easily removed from the guide roller, thereby, increasing safety and reliability of the automatic roll tape cutter.

BRIEF DESCRIPTION OF THE DRAWINGS

Other objects, features and advantages of the tape guide device of the present invention will be apparent from the following detailed description of the preferred embodiment of the invention in conjunction with the accompanying drawings, in which.

DETAILED DESCRIPTION OF THE PREFERRED EMBODIMENT

Figure 1:
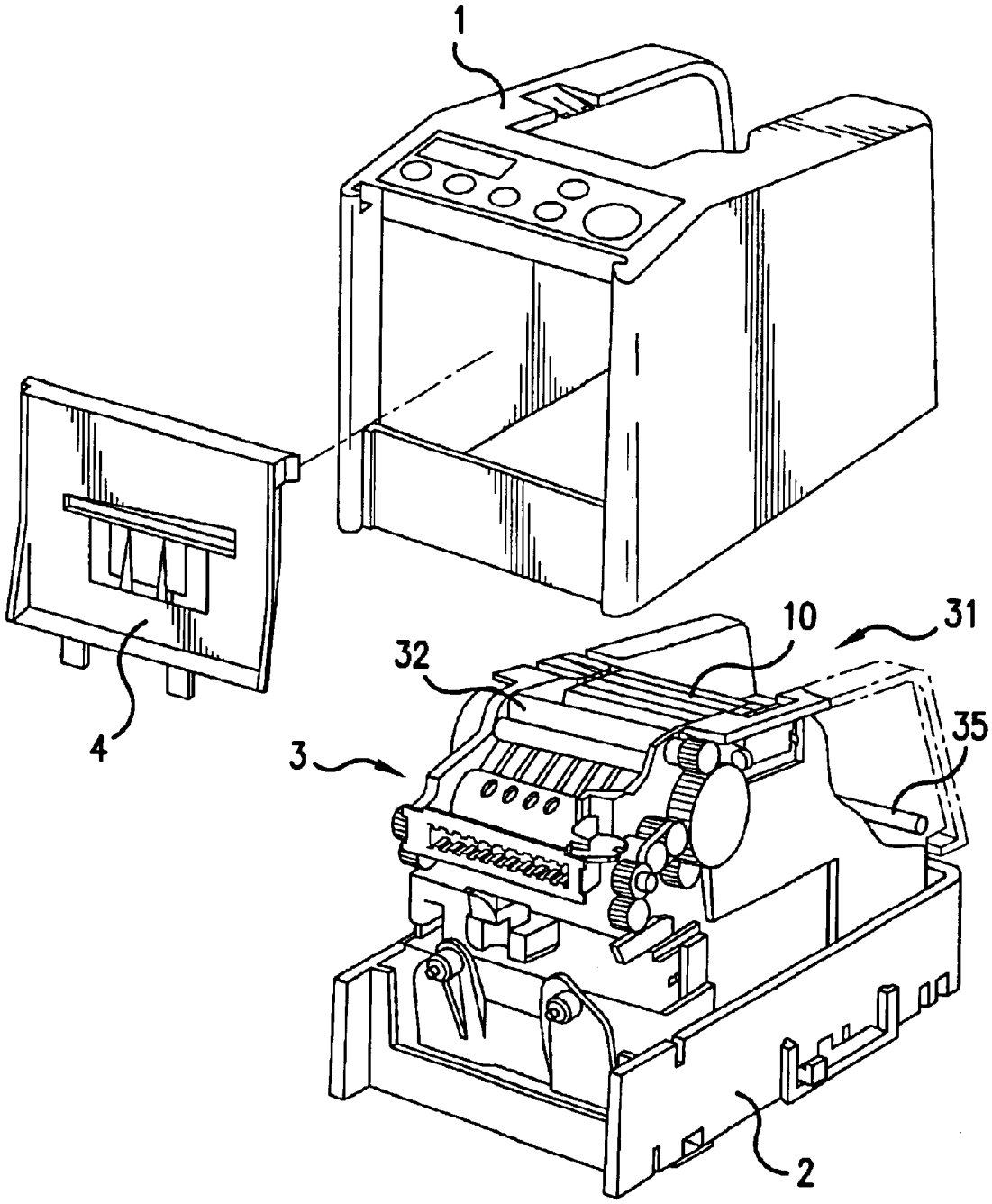
FIG.1 PRIOR ART
FIG. 1 is an exploded perspective view of conventional tape cutter.

A preferred embodiment of the tape guide device for automatic roll tape cutter according to the present invention will be described hereinbelow in detail with reference to the accompanying drawings.

As shown in FIGS. 1 to 7, a tape guide device 10 for the automatic roll tape cutter is positioned between a tape loading portion 31 and a supply roller 32 of a tape feed-out unit 3 so that the tape fed out from the rolls can be maintained under a proper tension. A plurality of guide rollers 35 are installed on a bottom of the tape loading portion 31 so as to support the roll tape.

Such a tape guide device 10 comprises a body 11 mounted between two side walls 33 and 34 of the tape feed-out unit 3 in such a manner as to be able to be opened and closed, first and second guide rollers 16 and 17 rotatably supported by rear and front ends of the body 11 for contacting the roll tape being fed out thereon, a pair of stoppers 18 mounted to the body 11 so as to selectively restrict rotation of the first guide roll 16, a grip 18*b* for operating the stopper pair and locking means 20 for fixing the body to be in a closed state.

The body 11 has, at a fixed end, two lugs 12 which are hingeably mounted to one side wall 33 of the tape feed-out unit 3 by means of a hinge pin 13. With a torsion spring 14 fitted around the hinge pin 13, the body is elastically biased to be opened. Two engaging protrusions 15 are protruded outwardly from a free end of the body 11 so as to elastically engage with hooks 21 of the locking means 20.

Two engaging recesses 16*a* are respectively formed coaxially with each other on an outer circumference of both end sides of the first guide roller 16 so that two fixing pieces 18*a* of the stopper 18 is inserted thereto. A plurality of engaging recesses 16*a* may be formed along the circumferential direction of the first guide roll 16 at certain angular intervals.

There is provided a pair of stoppers 18, which are oppositely disposed inside the body 11 in such a manner as to be spaced apart from each other by certain intervals so as to be axially moved. Each stopper 18 has, at its outer end, a radial fixing piece 18*a*, which is selectively protruded outwardly through a passing slot 11*a* of the body 11 to be inserted into the engaging recess 16*a* of the first guide roller 16. An upright grip 18*b* for horizontally moving the stopper 18 is provided at an inner end of each stopper in such a manner as to be protruded outwardly through an axially elongated guide slot 11*b* of the body 11. Preferably, two stoppers 18 are elastically biased radially by an arc-shaped plate spring 19.

The locking means 20 is pivotally mounted to the other side wall 34 of the tape feed-out unit 3 by means of a hinge pin 22 and elastically biased toward a closed direction by a spring 23. Two hooks 21 are formed at both ends of the locking means 20 in order to elastically engage with the both engaging protrusions 15 of the body 11, respectively.

An operation of the tape guide device of the present invention will be described hereinafter.

Figure 2:
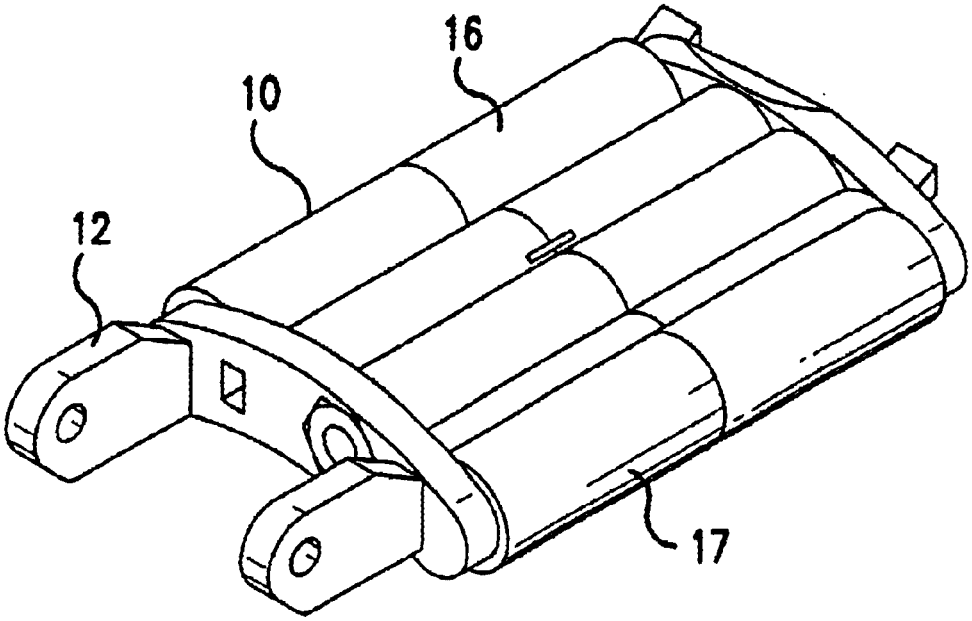
FIG. 2 is a perspective view showing a tape guide device according to the present invention.
Figure 3:
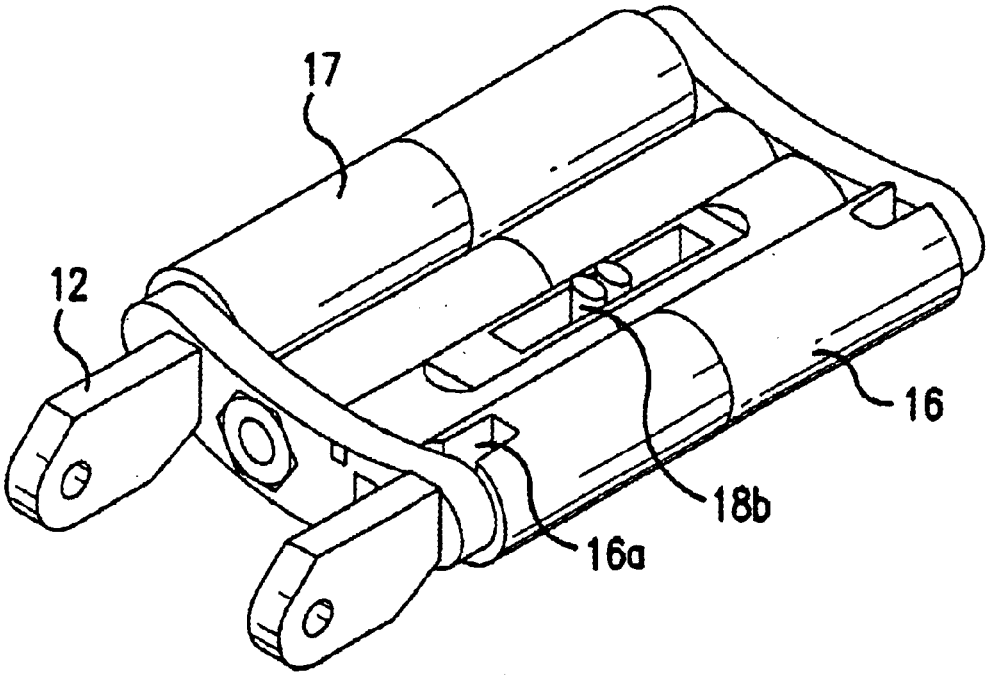
FIG. 3 is a perspective bottom view showing a tape guide device according to the present invention.

FIG. 2 is a perspective view showing a tape guide device according to the present invention.

Figure 5:
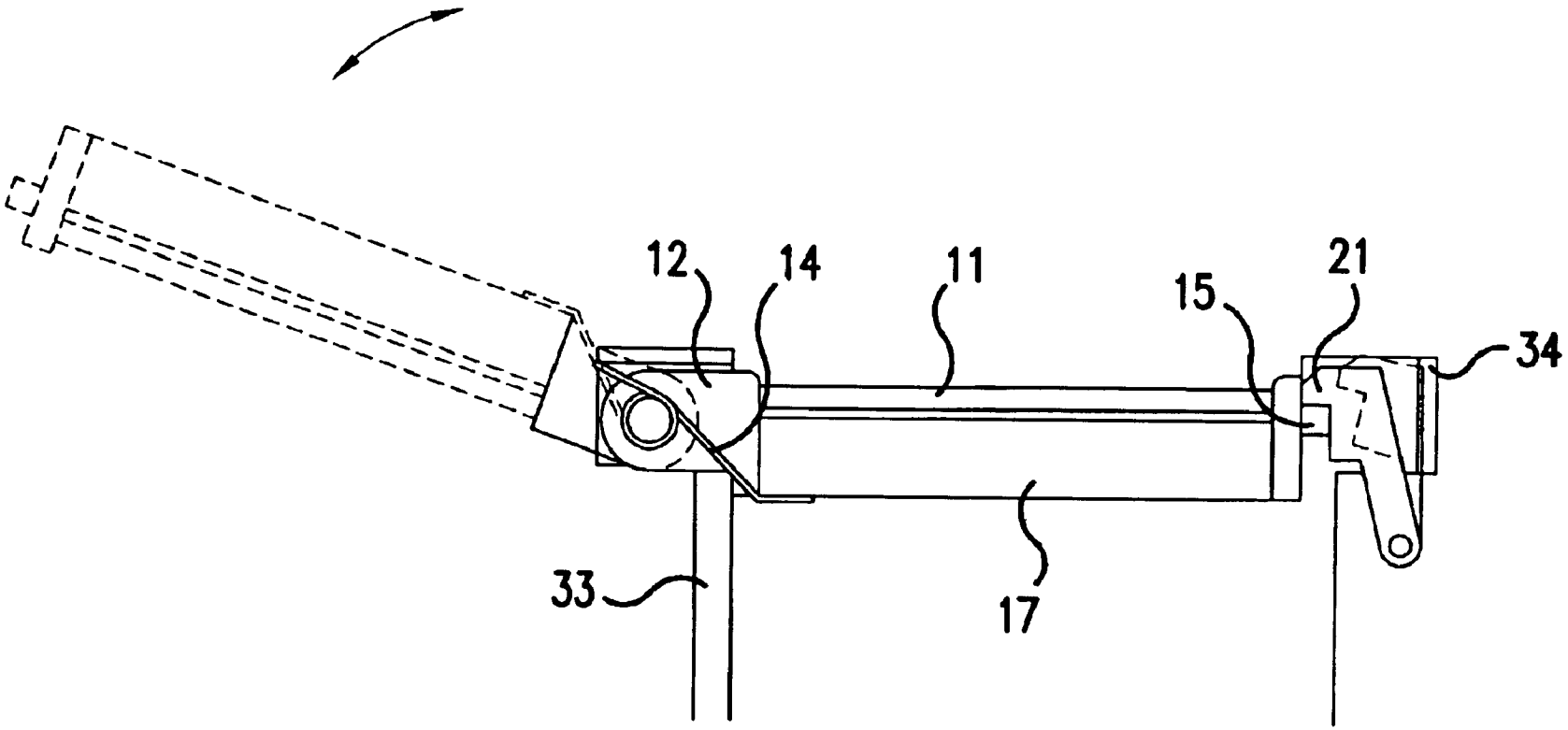
FIG. 5 is a front view showing a tape guide device according to the present invention in which the tape guide device is opened.
Figure 6A:
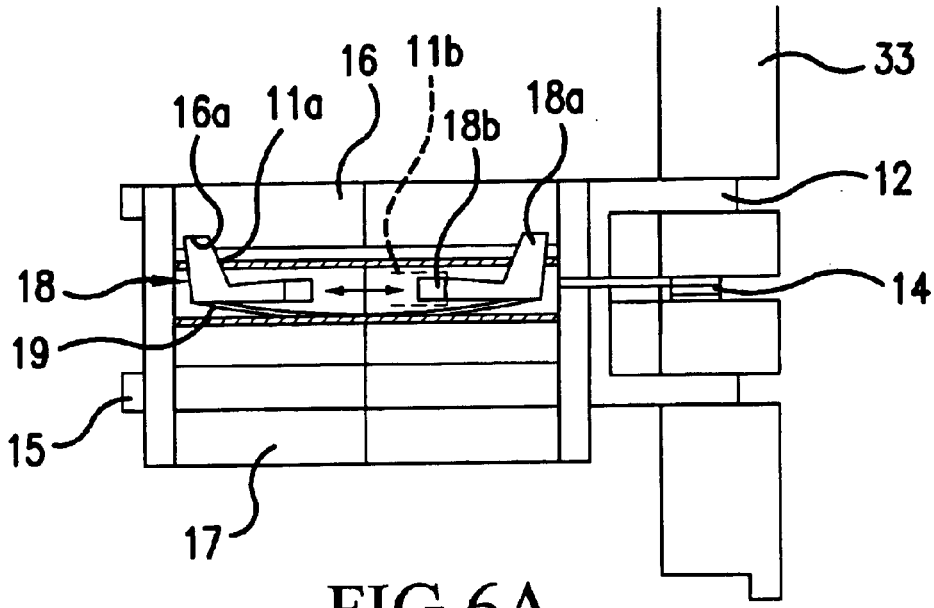
FIG. 6A is a plan view showing a tape guide device according to the present invention in which the tape guide device attached to one side wall is opened.
Figure 6B:
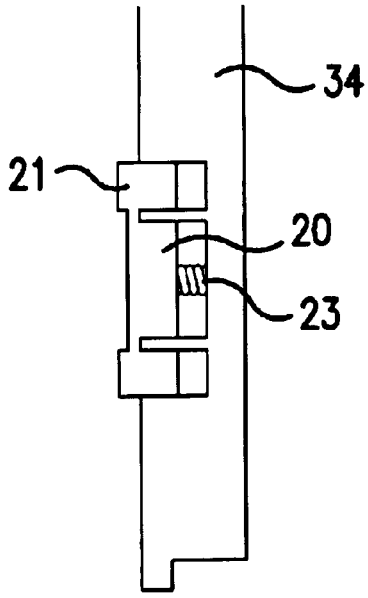
FIG. 6B is a plan view showing lock means attached to an opposing side wall which can cooperatively engage said tape guide device in a closed position.
Figure 7:
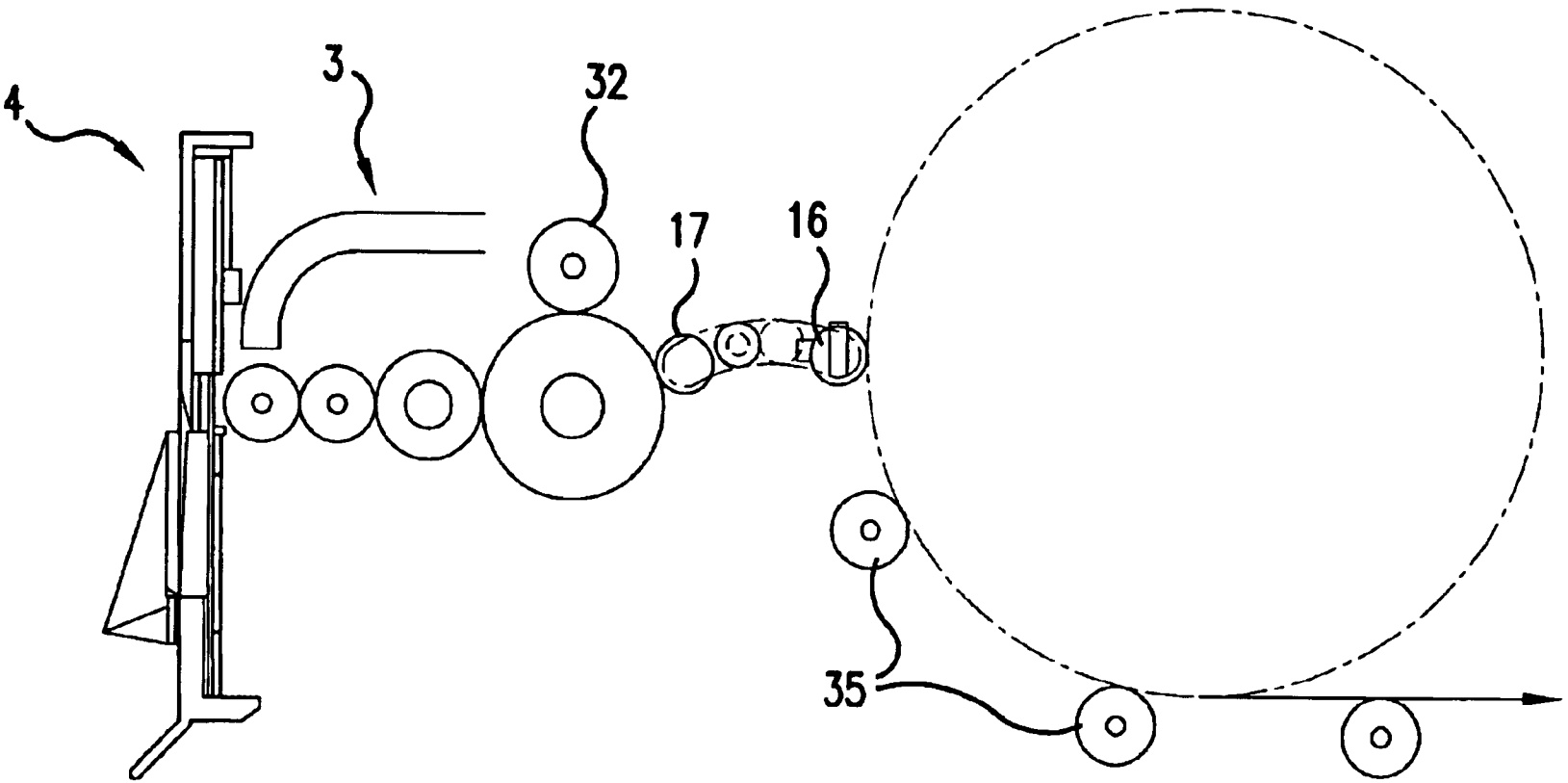
FIG. 7 is a schematic view showing a tape guide roll of the tape guide device according to the present invention.

As shown in FIG. 2, the tape guide device 10 of the present invention is in a closed state in which the engaging protrusions 15 of the body 11 are elastically engaged with the hook 21 of the locking means 20 so as to be fixed in position. In this state, when the locking means 20 is pressed toward a release direction, it will be rotated in a reverse direction while compressing the spring 23, which causes the hook 21 to release the restricted state of the engaging protrusions 15. Then, with a recovery elasticity of the torsion spring 14, the body will be rotated and opened as shown in FIG. 5.

When the body 11 is opened, a roll tape (not shown) is loaded in the tape loading portion 31 of the tape feed-out unit 3. Then, the leading part of the roll tape is bit by the supply roll 32 after properly drawing out the roll tape. The tape guide device 10 is closed as shown in FIG. 2. After that, the engaging protrusions 15 of the body 11 is elastically engaged with the hooks 21 of the locking means 20 while slidingly contacting the same, which allows the body to be fixed in a closed state. At this time, the roll tape will be not only subjected to a certain tension while being properly pressed to be contacted by the first and second guide rolls 16 and 17, but also smoothly fed out with rotation of the guide rolls 16 and 17 while forming a round curve without being fed out at a certain angle like the conventional prior tape guide device. Accordingly, the roll tape is not bent at a start point of its feed-out from the supply roller, so any deformation does not occur on the fed out roll tape, which effectively prevents the cut roll tape from being entangled or twisted.

Figure 4:
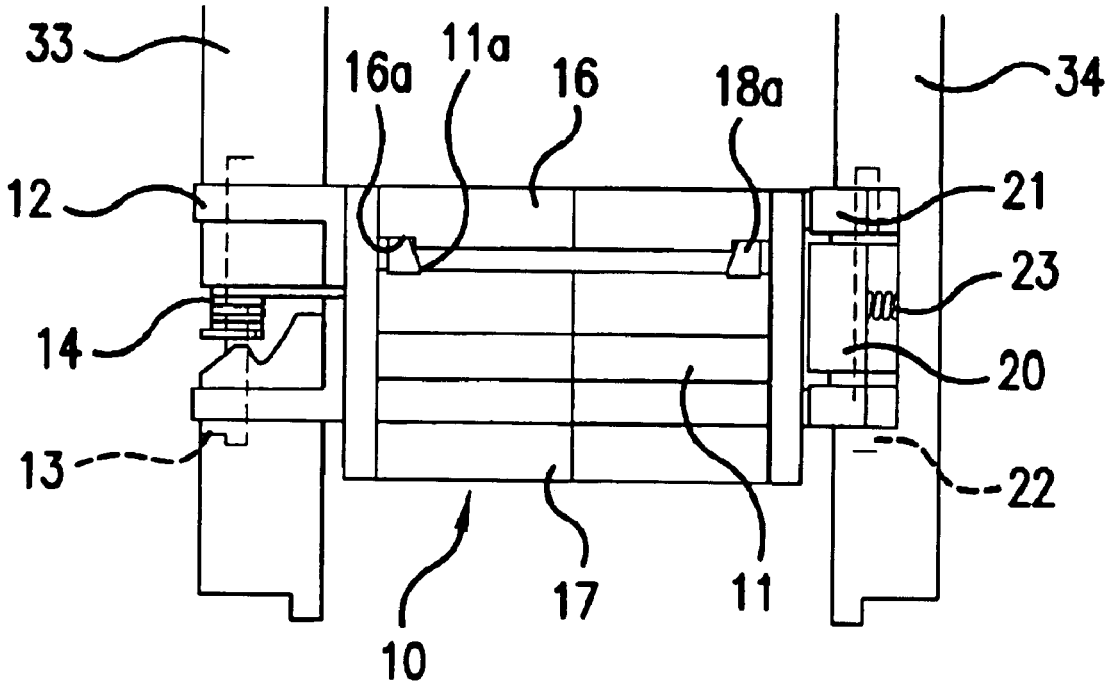
FIG. 4 is a plan view showing a tape guide device according to the present invention in which the tape guide device is closed.

In the case where the roll tape is easily released or where greater tension is required by the roll tape being fed out, as shown in FIG. 4, the body 11 is opened and two stoppers 18 are moved in an outer direction by use of the grip 18*b*. At the same time, the first guide roll 16 is properly rotated. Then, the fixing pieces 18*a* of the stopper 18 are outwardly protruded through the passing slot 11*a* of the body 11 by elasticity of the plate spring 19 and elastically inserted into the engaging recess 16*a* of the first guide roller 16 while being disposed to be opposite to each other, thereby restricting rotation of the first guide roller 16.

Like this, the body 11 is downwardly rotated and pressed after the rotation of the first guide roller 16 is restricted. Then, the locking means 20 is returned to its original position after being pushed backward by a sliding contact with the engaging protrusions 15, which allows the body to be fixed in a closed state. In this case, since the first guide roller 16 is not rotated during the feeding out of the tape, frictional resistance is generated on the roll tape being fed out, so that the tape can be fed out in a tightly stretchable state.

Further, since the roll tape is supported by a plurality of guide rollers 35 mounted at a bottom portion of the tape loading portion 31, it will be smoothly guided on the guide rollers despite a variation in its inner and outer diameters.

As described above, according to a tape guide device for an automatic roll tape cutter of the present invention, during the feeding out of a roll tape from a tape supply roller, the tape is fed out with it forming a round curve while maintaining a proper tension, so that a deformation such as a bending and entangling of the tape is not generated and the tape cut is not twisted or entangled. Also, the tension of the tape being fed out can be adjusted, if necessary, so that the tape can be fed out more smoothly.

The tape guide device of the present invention, accordingly, has a very excellent effect in improving convenience and reliability for use of the automatic roll tape cutter.

It should be understood that although preferred embodiments of the present invention have been described in order to illustrate the invention, the invention includes various modifications and equivalents to the disclosed embodiments, only some of which have been mentioned above. It is intended that the present invention include all such modifications and equivalents falling within the scope of the appended claims.

What is claimed is:

1. A tape guide device for an automatic roll tape cutter, the roll tape cutter including a tape feed-out unit housed in a case for feeding out a roll tape loaded in a tape loading portion thereof through a plurality of guide rollers from a supply roller thereof, and a tape cutting unit which is mounted in front of the case for cutting the tape fed out at a proper length, the tape guide device comprising:

a body disposed between the tape loading portion and the supply roller of the tape feed-out unit and having both ends, one end of which is hingeably mounted to one side wall of the tape feed-out unit as to be elastically biased toward an opening direction, and the other free end of which has engaging protrusions formed thereon;

a first guide roller installed at the rear end of the body and having engaging recesses formed on an outer circumference of both ends thereof;

a pair of stoppers horizontally installed inside the body in such a manner as to be moved oppositely with respect to each other, each of the stoppers having, at one end, a fixing piece protruded outwardly from the body so as to be inserted into the engaging recess of the first guide roller and being elastically biased toward its engaging direction;

a second guide roller installed at the front end of the body; and locking means mounted to the other side wall of the tape feed-out unit for restricting the engaging protrusions of the body so as to fix the body in a closed state.

2. The tape guide device for automatic tape cutter as claimed in claim 1, wherein the locker is hinged to the other side wall of the tape feed-out unit so as to be biased toward its locking direction, and has a hook for elastically engaging and restricting the engaging protrusions of the body.

3. The tape guide device for automatic tape cutter as claimed in claim 1, further comprising a plurality of guide rolls for supporting the roll tape at a bottom portion of the tape loading portion.

* * * * *